US010259606B2

(12) United States Patent
Gatteschi

(10) Patent No.: US 10,259,606 B2
(45) Date of Patent: Apr. 16, 2019

(54) METHOD AND APPARATUS FOR MAKING A BUNDLE OF CONTAINERS WITH CONTROLLED HEAT-SHRINKING, AS WELL AS A BUNDLE OBTAINED WITH SUCH A METHOD

(71) Applicant: OCME s.r.l., Parma (IT)

(72) Inventor: Carlotta Gatteschi, Parma (IT)

(73) Assignee: OCME, S.R.L., Parma (IT)

( * ) Notice: Subject to any disclaimer, the term of this patent is extended or adjusted under 35 U.S.C. 154(b) by 139 days.

(21) Appl. No.: 15/034,985

(22) PCT Filed: Nov. 7, 2014

(86) PCT No.: PCT/IB2014/065870
§ 371 (c)(1),
(2) Date: May 6, 2016

(87) PCT Pub. No.: WO2015/068130
PCT Pub. Date: May 14, 2015

(65) Prior Publication Data

US 2016/0288935 A1 Oct. 6, 2016

(30) Foreign Application Priority Data

Nov. 8, 2013 (IT) ..... MI2013A1858

(51) Int. Cl.
*B65B 21/24* (2006.01)
*B65D 71/08* (2006.01)
(Continued)

(52) U.S. Cl.
CPC ..... *B65B 21/245* (2013.01); *B65B 53/02* (2013.01); *B65B 53/063* (2013.01); *B65D 71/0085* (2013.01); *B65D 71/08* (2013.01)

(58) Field of Classification Search
CPC ..... B65B 53/063; B65B 53/02; B65B 21/245; B65D 71/08; B65D 71/0085; B65D 75/002; B65D 75/006
(Continued)

(56) References Cited

U.S. PATENT DOCUMENTS 3,664,088 A * 5/1972 Sherman ..... B65B 9/06 53/375.9
2011/0061339 A1* 3/2011 Hartness ..... B29C 65/106 53/203
(Continued)

FOREIGN PATENT DOCUMENTS

CN 102556391 A 7/2012
FR 2986509 A1 8/2013

OTHER PUBLICATIONS

State Intellectual Property Office of the People's Republic of China, First Office Action for Application No. 201480059596.0, dated Dec. 1, 2016.
(Continued)

*Primary Examiner* — Robert Long
*Assistant Examiner* — Xavier A Madison
(74) *Attorney, Agent, or Firm* — Ice Miller LLP

(57) ABSTRACT

Method for making a bundle (10) of the type comprising a plurality of containers (11) positioned along at least one row and wound in a heat-shrunk film (12) due to a heat-treatment effect; said method comprising the steps of: a) arranging a heat-shrinkable film (12) around said containers (11) ordered along at least one row in order to obtain an open tunnel (13) along the transverse direction (20) with respect to the longitudinal direction of advancement (20'), said open tunnel (13) identifying along said transverse direction (20) lateral over-edge portions (14) with respect to said containers (11); b) handling said over-edge portions (14); c) supplying said containers (11) and said heat-shrinkable film (12)
(Continued)

to a heat-treatment device, so that said over-edge portions (14) are compacted to said containers for heat-shrinking; in which said step of handling said over-edge portions comprises the step of making said over-edge portions (14) at least partially adhere to said containers (11).

2 Claims, 3 Drawing Sheets

(51) Int. Cl.
*B65D 71/00* (2006.01)
*B65B 53/02* (2006.01)
*B65B 53/06* (2006.01)

(58) Field of Classification Search
USPC ..... 53/442, 441, 557; 206/497
See application file for complete search history.

(56) References Cited

U.S. PATENT DOCUMENTS

2011/0139664 A1 6/2011 Ageling
2012/0117923 A1 5/2012 Hastreiter et al.

OTHER PUBLICATIONS

PCT/IB2014/065870, International Searching Authority, International Search Report, dated Feb. 13, 2015.
PCT/IB2014/065870, International Searching Authority, Written Opinion, dated Feb. 13, 2015.

* cited by examiner

METHOD AND APPARATUS FOR MAKING A BUNDLE OF CONTAINERS WITH CONTROLLED HEAT-SHRINKING, AS WELL AS A BUNDLE OBTAINED WITH SUCH A METHOD

The present invention refers to a method and to an apparatus for making a bundle of containers with controlled heat-shrinking.

Moreover, the present invention refers to the bundle obtained with the aforementioned method.

Today, particular product packages/containers, called bundles, are known and are available on the market which, in brief, correspond to a plurality of products ordered along at least one row wound in a heat-shrunk film.

Furthermore, the bundle can also comprise base supports that are in the form of a plate, called a pad, or in the form of a tray.

The methods known today for making a bundle as described above comprise the steps of:

- arranging an open tunnel of heat-shrinkable film around containers ordered along at least one row so that the heat-shrinkable film has, orthogonally to the longitudinal direction of advancement, over-edge portions with respect to the bulk of the containers;
- handling the over-edge portions;
- supplying the containers and the handled heat-shrinkable film to a heat-treatment device, or rather a ventilated oven, so that the over-edge portions are compacted to the containers by heat-shrinking.

EP2219954 describes a method for making a bundle according to the preamble of claim 1, in which the step of handling the over-edge portions provides for orderly folding the over-edges over themselves, in order to obtain, post-heat-shrinking, the complete closure of the lateral portions of the bundle.

According to other prior arts, which are less sophisticated than the one described in EP2219954, the step of handling the over-edge portions only provides the lifting/directing of the over-edge portions so that, post-heat-shrinking, they are compacted on the lateral front portions of the bundle leaving lateral openings.

The second prior art is used more often nowadays because it requires a lower consumption of film and because it is easier to implement.

Such a prior art provides that, as the dimensions of the containers vary, it is necessary to replace the film so as to always ensure that there is a wide over-edge portion.

Moreover, the film used must have a specific differentiated heat-shrinking, or rather:

- longitudinally, according to the direction of advancement of the bundle variable, indicatively from 50% to 80%;
- transversally orthogonally with respect to the direction of advancement of the bundle variable, indicatively from 0% to 35%.

However, this prior art has some drawbacks, such as the presence of creases on the finished bundle right at the areas of adhesion of the over-edge portions.

Such creases, which are generated during the heat-shrinking of the over-edge portions in ventilated ovens, can indeed prevent or make the handling of the finished bundle much more difficult.

Starting from such a prior art, the purpose of the present invention is that of implementing a method and an apparatus for making a bundle of the laterally open type which are an alternative with respect to those known and that are particularly efficient.

In detail, one purpose of the present invention is that of implementing a method for making a bundle that requires less consumption of film without jeopardising the stability of the bundle and without making any crease.

According to the most general aspect of the invention such purposes are achieved by controlling the arrangement of the over-edge portions with respect to the containers by making the film adhere to the products already upstream of the heat-shrinking oven.

In order to obtain such an effect it is possible to use rotating tines that are capable of making the film adhere perfectly to the product upstream of the heat-shrinking oven.

According to one particularly efficient embodiment, in addition to the adhesion it is also envisaged to be able to constrain the film on products already upstream of the heat-shrinking oven.

For example, as constraint means it is worth mentioning:

- possible use of a spray of adhesive materials on the product, in one or more points;
- possible use of a spray of adhesive materials on the film, in one or more points;
- possible use of adhesive tape that is applied to the film;
- possible use of means for electrostatically charging the film.

As can be understood, in such a way the heat-shrinking of the over-edge portions occurs in a more controlled manner since the film is already arranged in a suitable manner around the lateral portions of the products.

One first advantageous aspect of such a control is the reduction of the consumption of film without having the risk of excessively uncovering the lateral portions of the bundle.

The bundle with controlled heat-shrinking of the present invention can, indeed, be also made with a film the orthogonal dimension of which is reduced by 10% to 35% with respect to the advancing of the bundle itself compared to a conventional bundle made with the prior art.

In addition to the smaller consumption, the aforementioned control ensures that a film can be used, the heat-shrinking factor of which, orthogonal to the direction of advancement of the bundle, is close to zero and that the over-edge portion is controlled when the heating/heat-shrinking step of the film begins.

This type of film makes it possible to eliminate the creases that can normally form in this step of the process.

Another advantage, related to the fact that the constancy of the adhesion of the film on the product is ensured, consists of improving the lateral protection of the product itself.

In the case in which a neutral film is used, by suitably orienting the product—moreover as occurred in the prior art—a label or a print of the product itself can be used as the final image of the bundle with obvious reduction of costs and of logistics.

Indeed, only one dimension of band of film can pack different types of products making it possible to use a code, for example a "QR Code", as an identification element for the package.

Further characteristics of the invention shall be highlighted in the dependent claims.

The characteristics and the advantages of a method for making a bundle according to the present invention shall become clearer from the following description, given as an example and not for limiting purposes, with reference to the attached schematic drawings, in which.

Figure 1:
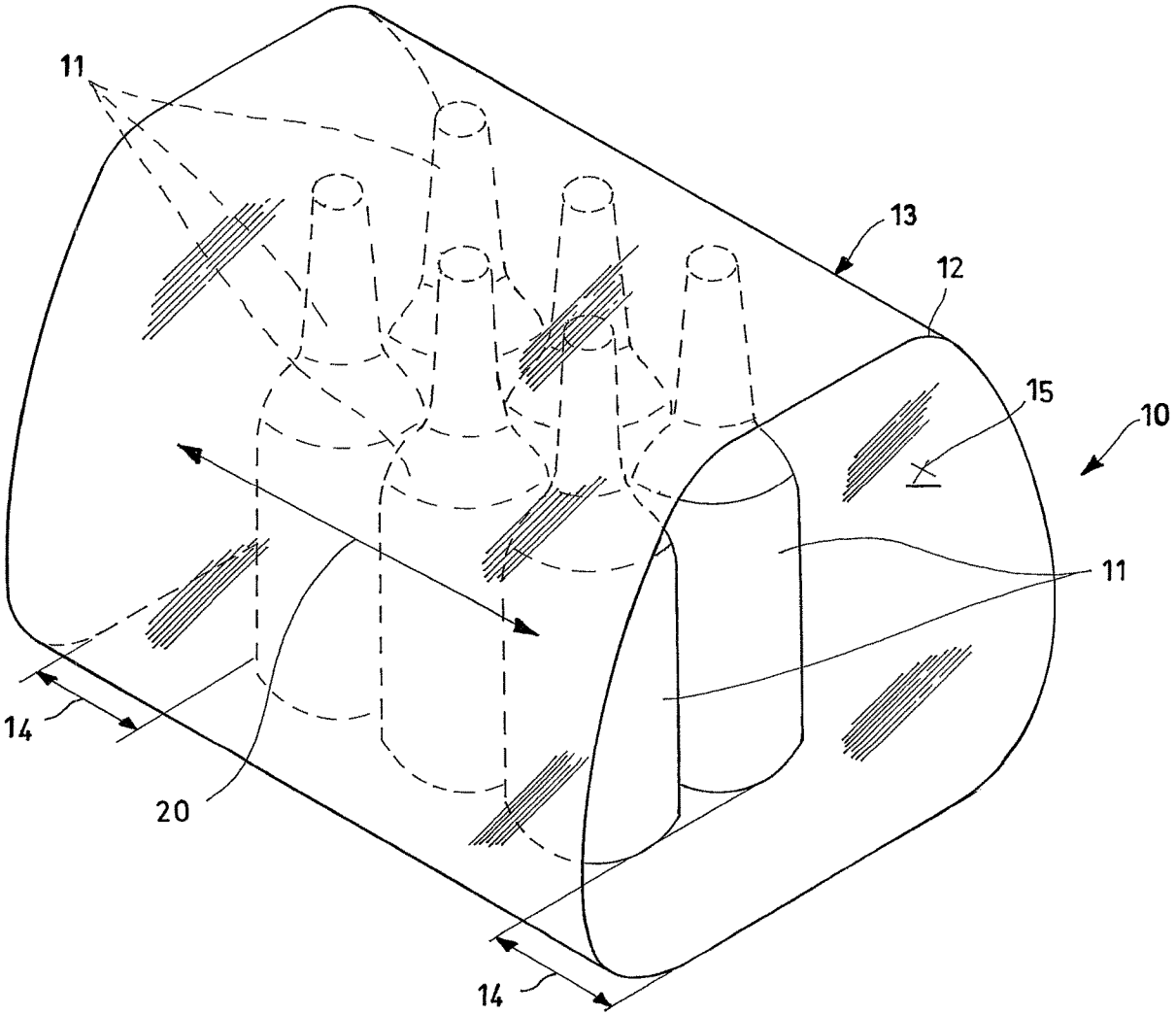
FIG. 1 shows a first step of making the bundle according to the present invention upstream of the heat-shrinking oven.

With reference to the figures, reference numeral 10 shows a bundle of containers, bottles, cans, multipacks, cluster packs, boxes, etc., which are obtained with the method object of the present invention.

Such a bundle 10 is of the type comprising a plurality of containers 11 that are positioned along at least one row and are wound in a film 12, in particular a heat-shrinkable film.

The method comprises the steps of:

a) arranging a heat-shrinkable film 12 around containers 11 that are ordered along at least one row in order to obtain an open tunnel 13 along the transverse direction 20 with respect to the longitudinal direction of advancement 20'; such an open tunnel 13 defines along the transverse direction 20 lateral over-edge portions 14 with respect to the containers 11;

b) handling the over-edge portions 14;

c) supplying the containers 11 and the heat-shrinkable film 12 to a heat-treatment device, so that the over-edge portions 14 are compacted to the containers 11 by heat-shrinking.

In particular according to the invention, the step of handling the over-edge portions 14 comprises the step of making the over-edge portions 14 at least partially adhere to the containers 11 upstream of the heat-treatment device.

For example, such a heat-treatment device is a ventilated oven, whereas the tunnel 13 can be many sheets of film 12 that are joined together and folded back on themselves.

Furthermore, in addition to the simple adhesion of the film 12 on the containers 11, the present invention also provides the possibility of at least partially constraining the over-edge portions 14 in the configuration of adhesion to the containers 11.

Figure 2:
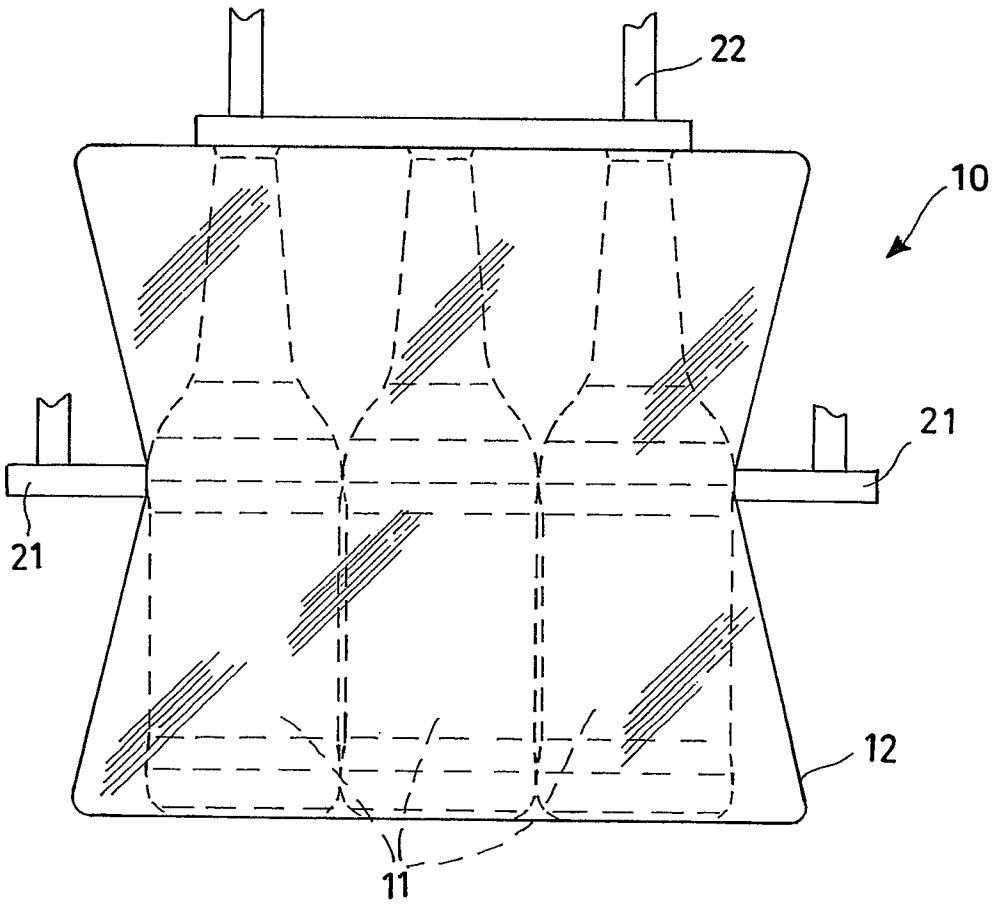
FIG. 2 shows a second step for making the bundle according to the present invention upstream of the heat-shrinking oven.
Figure 3:
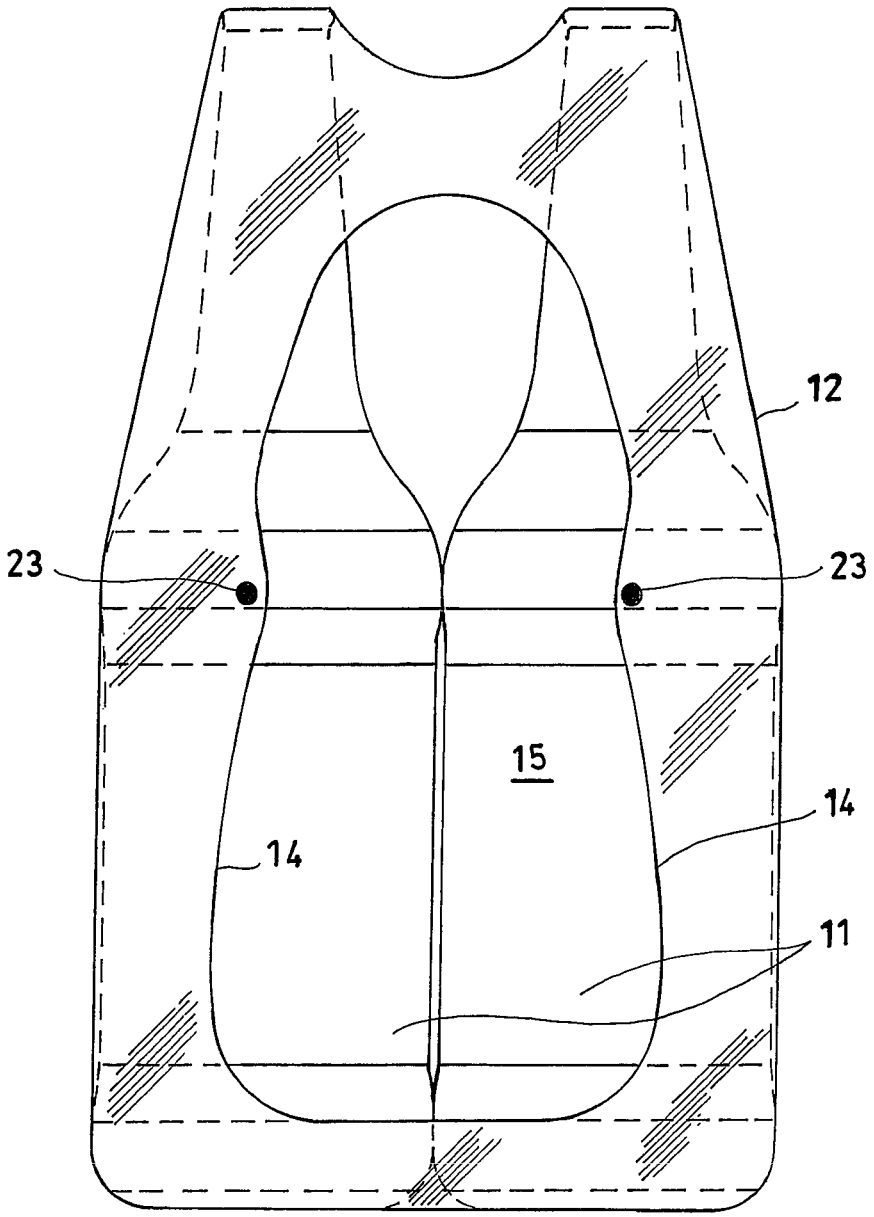
FIG. 3 shows the bundle finished with the method of the present invention.

FIG. 2 schematically shows the technical means 21, such as mechanical tines, for bringing the over-edge portions 14 in contact with the front and rear portions of the containers 11.

Such a constraint can be achieved through bonding agents between the film 12 and containers 11 or simply by electrostatically charging the over-edge portions 14.

For example, the glue 23 can be duly arranged through spraying nozzles on the containers 11 and/or on the film 12.

Alternatively, adhesive tapes can be arranged on the film 12 before the adhesion to the container.

In combination with the lateral tines 21 an upper stabilizing device 22 can be provided.

The bundle 10 obtained with the method described has particular characteristics, like not having creases and/or the presence of constraint points 24 between the film 12 and the containers 11.

The apparatus for the implementation of the method according to the invention comprises:

means for handling and orienting the containers 11 and the film configured for arranging the heat-shrinkable film 12 around the containers 11 ordered along at least one row so as to form an open tunnel 13 of heat-shrinkable film 12, in which such a tunnel 13 has orthogonally 20 with respect to the longitudinal direction of advancement 20' over-edge portions 14 with respect to the containers 11;

means for handling the over-edge portions 14;

heat-treatment means of the bundle, so that the over-edge portions are compacted to the containers by heat-shrinking.

According to the invention, the handling means of the over-edge portions 14 are configured for impressing the at least partial adhesion of the over-edge portions 14 to the containers 11 operating upstream of the heat-treatment means.

It can also be provided for there to be means for constraining the over-edge portions 14 in the configuration adherent to the containers operating upstream of the heat-treatment means.

It has thus been seen that the method for making a bundle according to the present invention achieves the purposes previously highlighted.

Indeed, the method for making a bundle according to the present invention requires less consumption of film without jeopardising the stability of the bundle and without making any crease.

The method of the present invention thus conceived can undergo numerous modifications and variants, all covered by the same inventive concept; moreover, all the details can be replaced by technically equivalent elements. In practice, the materials used, as well as their dimensions, can be of any type according to the technical requirements.

The invention claimed is:

1. Method for making a bundle of a laterally type comprising a plurality of containers positioned along at least one row and wound in a heat-shrunk film due to a heat-treatment effect; the method comprising the steps of:

a) arranging a heat-shrinkable film around said containers ordered along at least one row so as to obtain an open tunnel along the transverse direction with respect to the longitudinal direction of advancement, the open tunnel identifying along the transverse direction lateral over-edge portions with respect to the containers;

b) handling the over-edge portions;

c) supplying the containers and said heat-shrinkable film to a heat-treatment device, so that the over-edge portions are compacted to the containers for heat-shrinking delimiting lateral openings of said bundle;

wherein the step of handling the over-edge portions comprising the step of making the over-edge portions at least partially adhere to the containers, the intermediate step of making the over-edge portions adhere to the containers comprising the step of at least partially constraining the over-edge portions in the adhesion configuration to the containers by arranging a bonding agent between the film and the containers.

2. Method according to claim 1, wherein the step of arranging a bonding agent between the film and the containers comprises spraying the bonding agent on the containers and/or on the film.

* * * * *